US005235390A

United States Patent [19]

Ishikawa

[11] Patent Number: 5,235,390

[45] Date of Patent: Aug. 10, 1993

[54] DEVELOPING DEVICE WITH TONER CARTRIDGE COVER SHAPED TO PREVENT LEAKAGE

[75] Inventor: Takashi Ishikawa, Tokyo, Japan

[73] Assignee: Kabushiki Kaisha Toshiba, Kanagawa, Japan

[21] Appl. No.: 960,283

[22] Filed: Oct. 13, 1992

Related U.S. Application Data

[63] Continuation of Ser. No. 655,712, Feb. 19, 1991, abandoned.

[30] Foreign Application Priority Data

Mar. 20, 1990 [JP] Japan ..... 2-28773[U]

[51] Int. Cl.[5] ..... G03G 15/06

[52] U.S. Cl. ..... 355/260; 141/369; 141/371; 141/375; 222/375; 222/DIG. 1

[58] Field of Search ..... 355/260, 245, 246; 222/DIG. 1, 325, 541, 561; 141/346, 369, 370, 371, 375, 383, 386

[56] References Cited

U.S. PATENT DOCUMENTS 4,491,161 1/1985 Tamura et al. ..... 141/364
4,972,887 11/1990 Hacknauer et al. ..... 141/346
5,175,588 12/1992 Katagata ..... 355/260

FOREIGN PATENT DOCUMENTS 0032574 2/1988 Japan ..... 355/260
0148073 6/1990 Japan ..... 355/260

*Primary Examiner*—Leo P. Picard
*Assistant Examiner*—Christopher Horgan
*Attorney, Agent, or Firm*—Finnegan, Henderson, Farabow, Garrett & Dunner

[57] ABSTRACT

A developing device including a device body which has a toner reception port and supplies toner stored therein to a photosensitive member, a toner cartridge, which is detachably mounted in the device body has a toner discharge port opposed to the toner reception port, and supplies toner stored therein to the device body through the ports, and a toner cartridge cover which has a side that is connected to the device body without a gap. When the toner cartridge is removed from the device body of the developing device to the toner cover, the toner left in the toner cartridge doesn't leak out the gap between the toner cartridge and the cartridge cover and the surroundings of the developing device are not soiled with the toner.

6 Claims, 13 Drawing Sheets

DEVELOPING DEVICE WITH TONER CARTRIDGE COVER SHAPED TO PREVENT LEAKAGE

This application is a continuation of application Ser. No. 07/655,712, filed Feb. 19, 1991, now abandoned.

BACKGROUND OF THE INVENTION

1. Field of the Invention

The present invention relates to a developing device provided in an electrophotographic recorder.

2. Description of the Related Art

An electrophotographic recorder used as a copying machine, a facsimile, a laser printer, etc has a charger, an exposure device, a developing device, a transfer device, and a fixing device sequentially arranged around a photosensitive drum in its rotating direction.

In the operation of the recorder, the photosensitive drum is caused to rotate, the exposure device exposes the charged surface of the rotating drum to form a latent image, the developing device develops the latent image on the surface of the rotating drum with toner to form a toner image the transfer device transfers the toner image from the surface of the drum to a recording paper, and the fixing device fixes the toner image on the recording paper.

The developing device provided in the electrophotographic recorder stores toner in its device body and supplies toner from the device body to the surface of the photosensitive drum.

When the toner in the device body is exhausted, toner is supplied into the device body.

In one method to supply toner into the device body of the developing device, an exchangeable toner cartridge is used.

The toner discharge port of the toner cartridge is covered with a strip-shaped sheet.

When the toner cartridge is mounted in the device body of the developing device, the flange of the toner cartridge is inserted to the guide rails of the device body, and the toner cartridge is slid along the guide rails of the device body until the front flange of the toner cartridge contacts and fits into the stopper of the device body.

The toner discharge port of the toner cartridge then coincides with the toner reception port of the device body.

The externally projecting end of the strip-shaped sheet is pulled by the operator to separate the strip-shaped sheet from the toner cartridge, so that the toner discharge port is opened, and the toner stored in the toner cartridge is discharged from the opened toner discharge port into the device body through the ports.

When the toner in the device body 8 of the developing device is exhausted, the front edge of a cartridge cover 16' is connected to the edge 15 of the device body 8, and the toner cartridge 19' is slid along the guide rails 17 of the toner cover 16' and the guide rails 17 of the device body 12, until the front flange of the toner cartridge 19' is located at the stopper piece 18, as shown in FIG. 11.

However the conventional cartridge cover has the following problems.

The cartridge cover of the conventional developing device is made from a material which is flexible, for example vinyl chloride.

Thus the edge of the cartridge cover 16' is sometimes caught on the edge of the toner discharge port 20, when the toner cartridge 19' is slid from the upper portion of the device body 8 to the base **16*a* of the cartridge cover 16' and the base 16*a* of the cartridge cover 16' is bent inward toward the toner cartridge 19' as shown in FIG. 12**(*b*).

As shown in FIG. 13, the edge **16*z* of the conventional cartridge cover 16'** is vertical to the direction in which the toner cartridge is removed from the device body to the cartridge cover.

And as shown in FIG. 14, the edge **19*z* of the conventional toner cartridge 19'** is vertical to the direction in which the toner cartridge is removed from the device body to the cartridge cover.

When the base **16*a* of the cartridge cover 16' is bent inward toward the toner cartridge 19', the edge 16*z* of the cartridge cover 16' is caught on the edge 19*z* of the toner discharge port 20, and the base 16*a* of the cartridge cover 16' doesn't cover the toner discharge port 20** perfectly.

The toner resting in the toner cartridge 19' thus leaked out of the gap between the toner cartridge 19' and the device body 8.

SUMMARY OF THE INVENTION

It is an object of the present invention to provide a developing device in which a cartridge cover can cover a toner discharge port of a toner cartridge perfectly, without toner leaking out of the gap between the toner cartridge and the device body when the toner cartridge is dismounted from the device body.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

FIG. 1 is a side view showing a facsimile machine using the developing device of the present invention.

FIG. 2 is a perspective view of the device body of the developing device.

FIG. 3 (*a*) to FIG. 5 (*a*) are top views of a cartridge cover of the developing device.

FIG. 3 (*b*) to FIG. 5 (*b*) are slant views of a cartridge cover of the developing device.

FIG. 6 (*a*), (*b*) and FIG. 7 (*a*), (*b*) are perspective views of a toner cartridge of the developing device.

FIG. 6 (*b*) and FIG. 7 (*b*) show bottom views of the toner cartridge as shown in FIG. 6 (*a*) and FIG. 7 (*a*).

FIG. 8 to FIG. 10 are perspective views showing the use of the toner cover connected to the device body of the developing device.

DETAILED DESCRIPTION OF THE PREFERRED EMBODIMENTS

Figure 1:
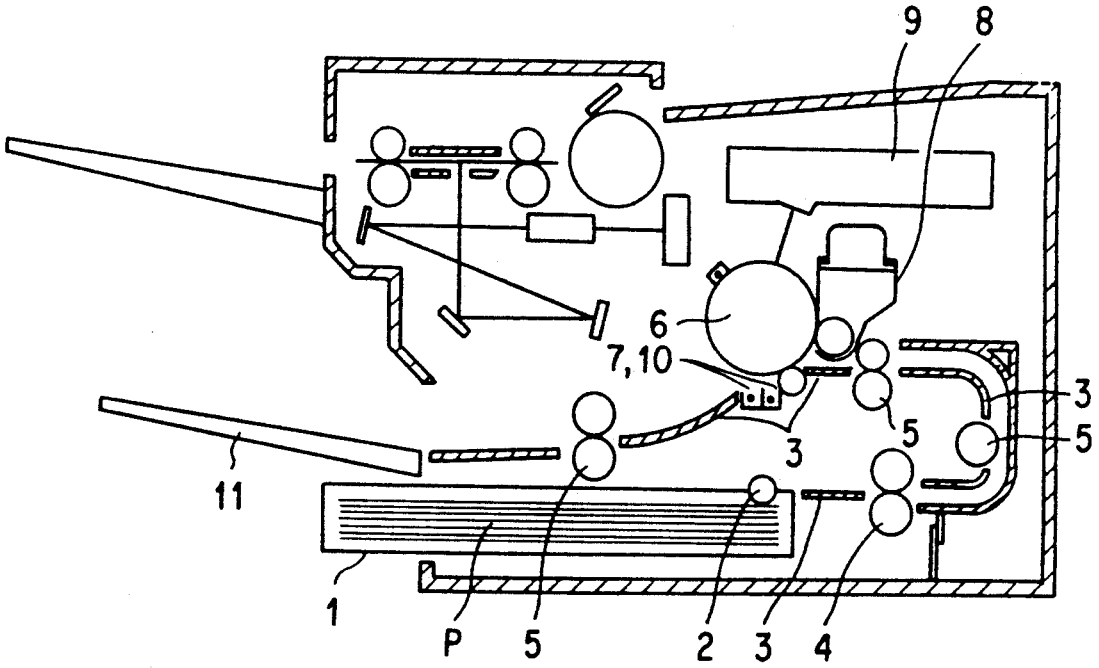
FIG. 1 to FIG. 10 show an embodiment of a developing device according to the present invention.

FIG. 1 shows a facsimile, one embodiment of an electrophotographic device using the developing device of the present invention.

Recording paper P is the medium on which is recorded pictures and characters.

Casette 1 is provided to accumulate the recording paper P in its body.

Supplying Roller 2 picks up the recording paper P from the cassette 1.

Guide 3 decides the route of the recording paper P.

Sending Roller 5 sends the recording paper P along the guide 3.

Dividing Roller 4 divides one sheet of recording paper from several sheets of recording paper P.

Photosensitive drum 6 records the picture information when the surface of its body is exposed to the light which contains the picture information.

Developing device 8 supplies the toner to the photosensitive drum 6.

Exposure device 9 exposes the light having the picture information to the photosensitive drum 6.

The developing device 8 supplies the toner to the surface of the photosensitive drum 6, as explained above.

Fixing device 7 fixes the toner image on the recording paper P.

Transfer device 10 transfers the toner image from the surface of the photosensitive drum 6 to the recording paper P.

Stacker 11 stacks the recording paper P which is sent from the photosensitive drum 6.

In the operation of recording the image, the recording paper P accumulated in the casette 1 is picked up by the supplying roller 2, first of all.

The recording paper P is separated from other recording paper, and is sent to the photosensitive drum 6 along the guide 3 by the sending roller 5.

The recording paper P records the toner image on the surface by the photosensitive drum 6, which is exposed to light by the exposure device 9, and is supplied toner by the developing device 8.

The image is transferred to the recording paper P by the transfer device 10, and is fixed by the fixing device 7.

Finally, the recording paper P is stacked on the stacker 11.

The developing device 8 of the present invention consists of the device body, the toner cartridge 19', and the cartridge cover 16.

Figure 2:
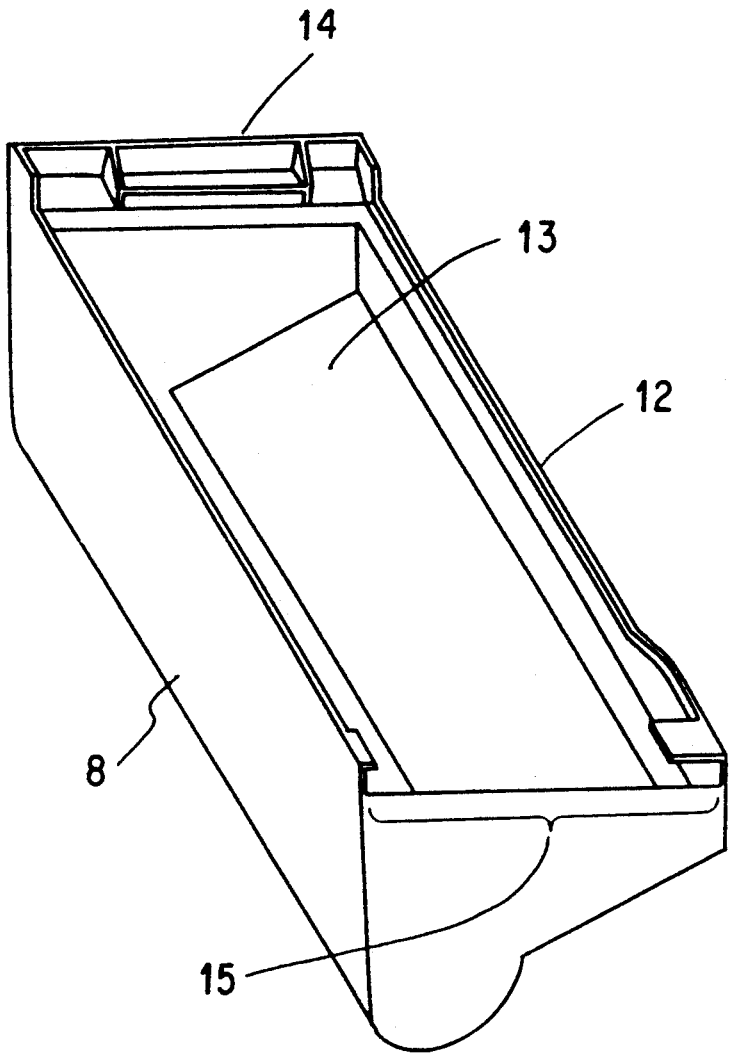

FIG. 2 shows the device body 8 of the developing device.

The device body 8 has toner reception port 13 which is formed at the center of the upper plate of the case.

A pair of guide rails 12 are formed at the longitudinal side edges of the upper plate along both longitudinal sides of the toner reception port 13.

The guide rails 12 support the toner cartridge slidably.

A toner cartridge mounting port is defined by the surface of the upper plate of the case, the inner side surface of the guide rails and a stopper 14 at the end of the guide rails 12, which is formed to bridge over both the guide rails 12.

Figure 3A:
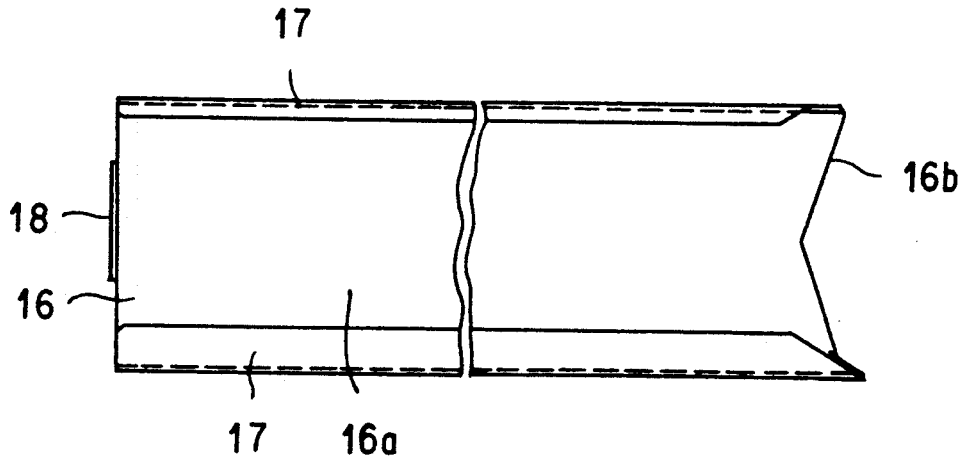
Figure 3B:
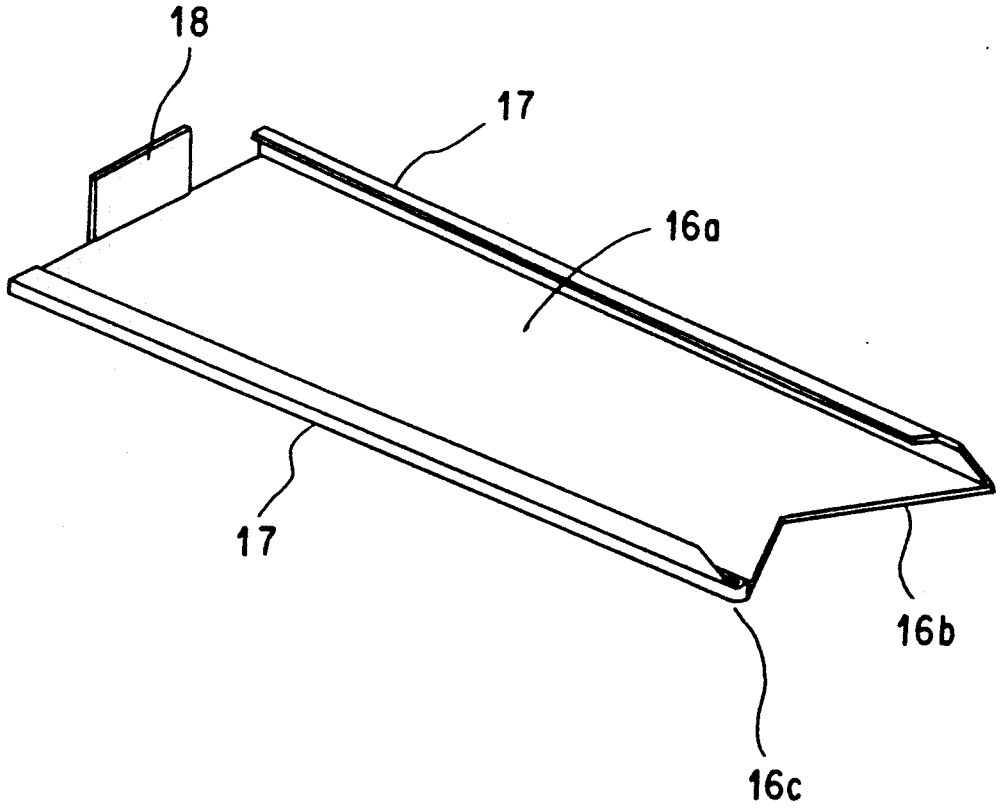
Figure 4A:
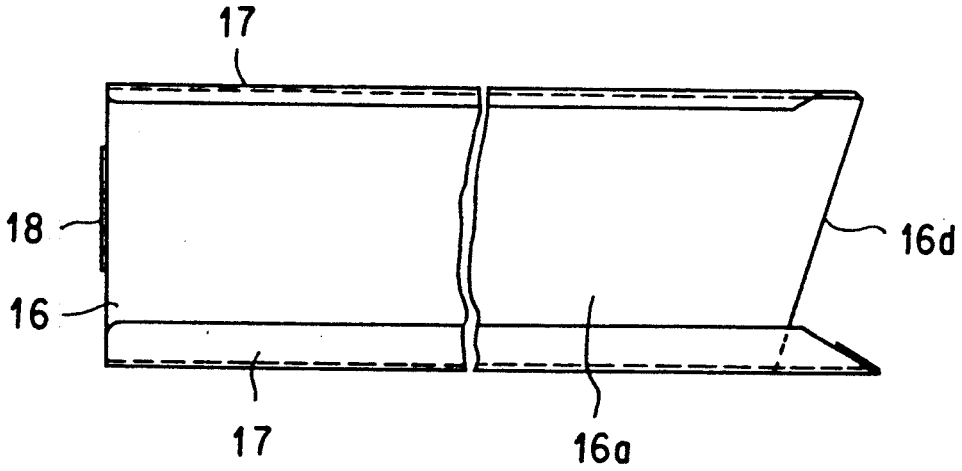
Figure 4B:
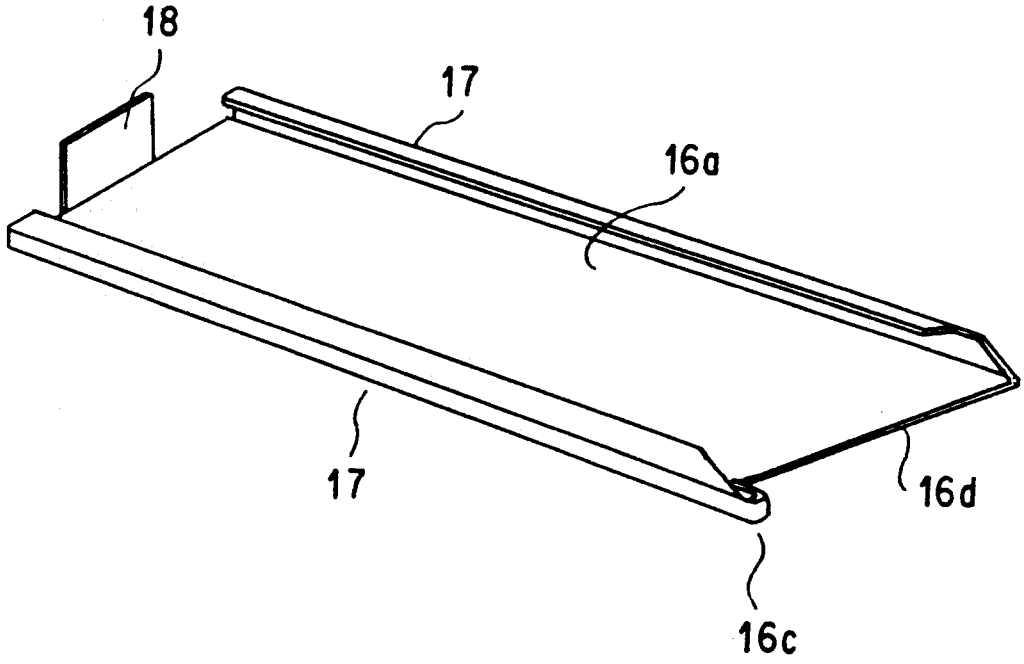
Figure 5A:
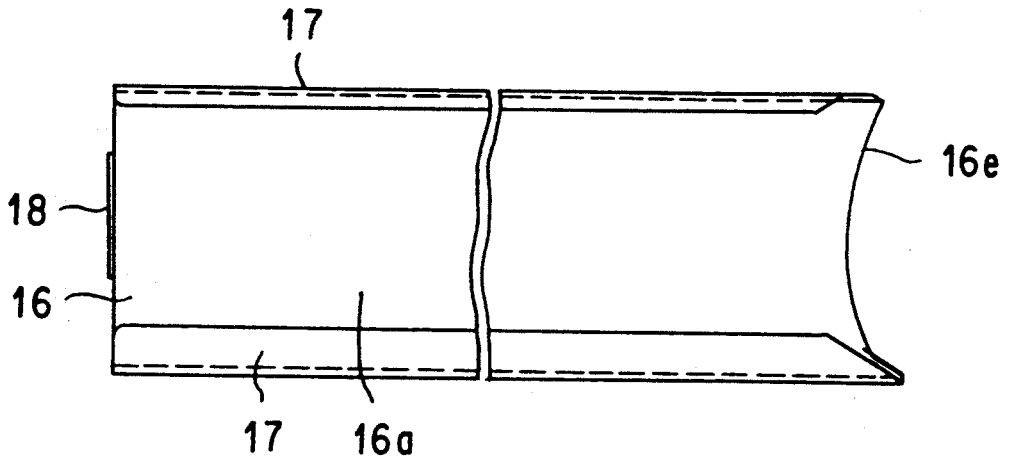
Figure 5B:
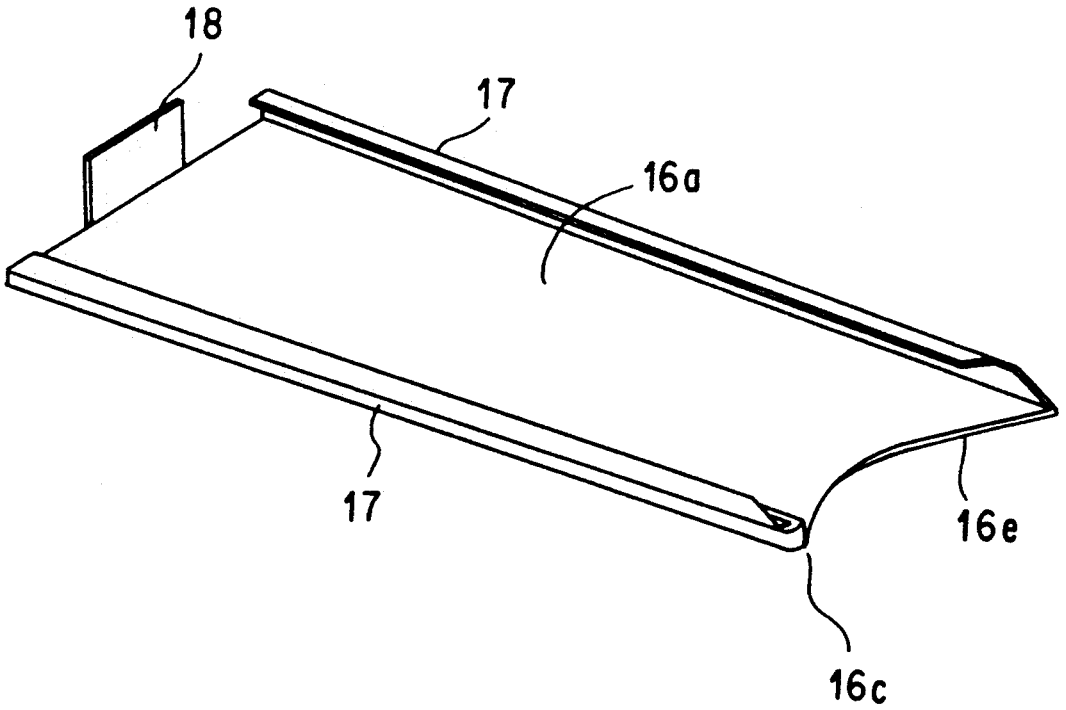

FIG. 3 to FIG. 5 are perspective views of a cartridge cover.

The cartridge cover 16 has a base **16*a*** having substantially the same dimension as the lower plate of the cartridge.

Guiderails 17 are located at both longitudinal side edges on the base **16*a***.

The guiderails 17 are formed in a strip-shape for laterally retaining flanges formed at both side edges of the toner cartridge.

Each guiderail 17 extends in the longitudinal direction and has an U-shaped cross-section, so that the outer side surface and the upper and lower surfaces thereof can slidably guide each flange of the toner cartridge.

A releasing member **16*c*** is composed of an elastic piece extending externally rearwardly from one end of one guide rail.

A stopper piece 18 is located at the rear end of base **16*a***.

In this embodiment, the base **16*a*, the guide rail 17, and the stopper piece 18**, are integrally formed of synthetic resin sheet, for example vinyl chloride sheet.

The front edge **16*b* of the cartridge cover as shown in FIG. 3** is shaped to be a V, and thus can avoid the force from the edge of the toner cartridge when it is slid over the cartridge.

The front edge **16*d* of the cartridge cover as shown in FIG. 4** is shaped to be slanted to the direction in which the toner cartridge is slid.

The front edge **16*e* of the cartridge cover as shown in FIG. 5** is shaped to be a U.

Figure 6A:
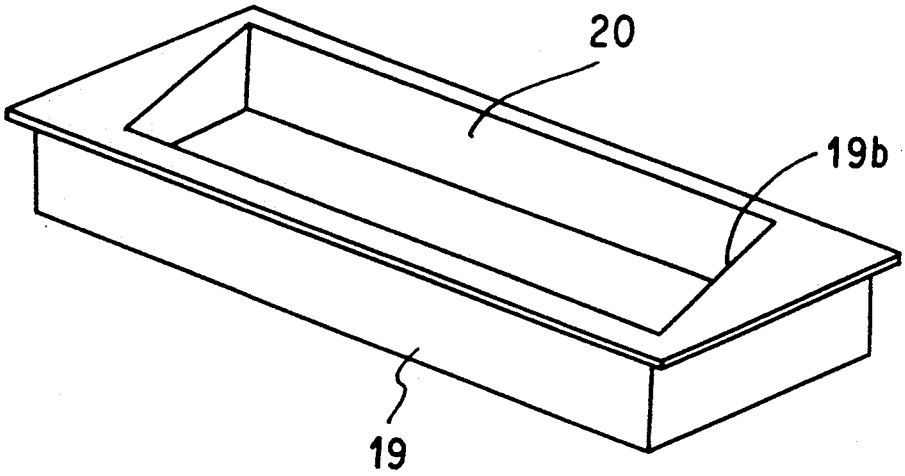
Figure 6B:
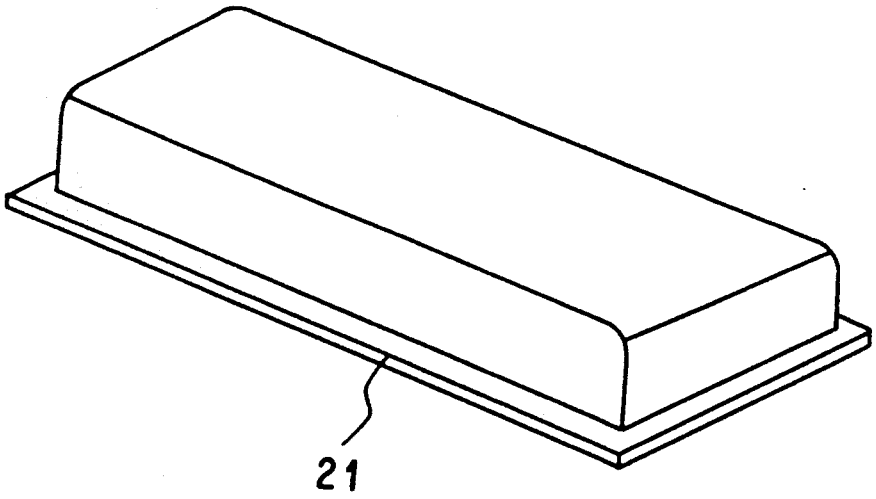
Figure 7A:
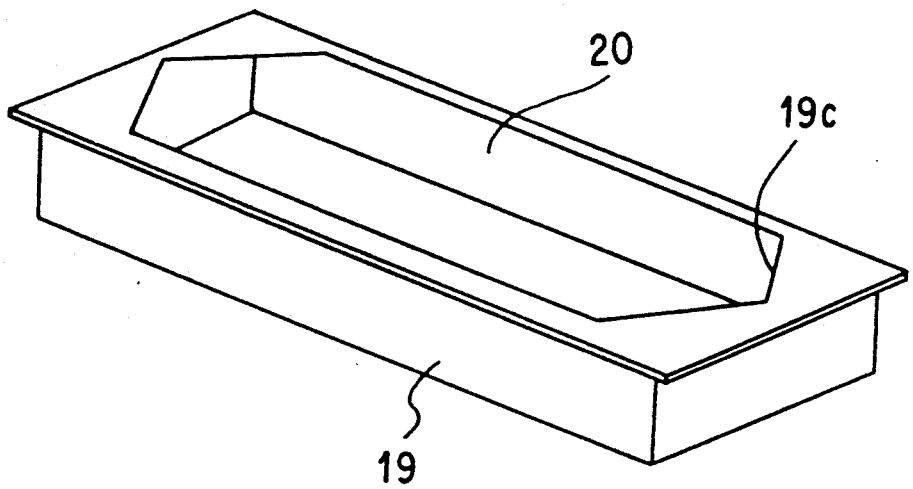
Figure 7B:
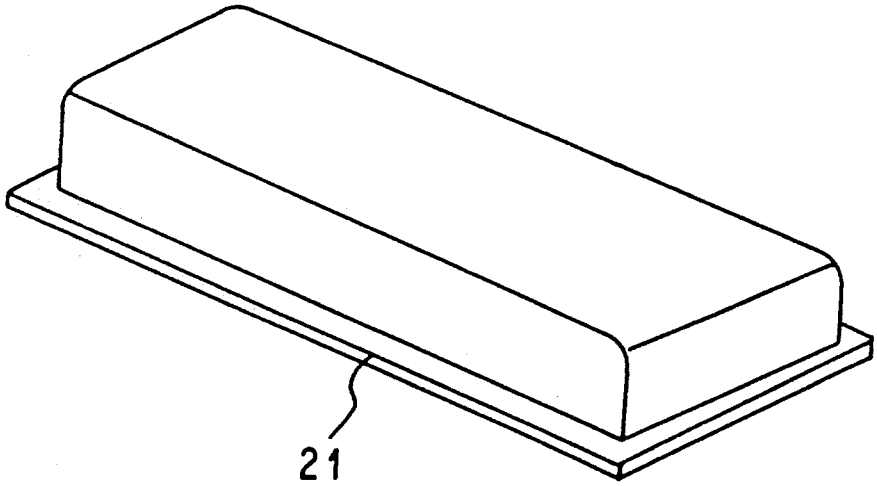

FIG. 6 (*a*) and FIG. 7 (*a*) show a toner cartridge, according to another embodiment of this invention, and FIG. 6 (*b*) and FIG. 7 (*b*) show the bottom of the toner cartridge as shown in FIG. 6 (*a*) and FIG. 7 (*a*). As is evident from the drawings, a conventional cartridge cover may be used if the opening of the toner cartridge is designed as a V, a U, or slant shape as shown in FIG. 6 and FIG. 7.

Toner cartridges 19 store the toner to be supplied into the device body 8 of the developing device.

A toner cartridge 19 has a toner discharge port 20 for discharging the stored toner at a lower surface of its body.

The toner cartridge 19 has a flange 21 around the toner discharge port 20.

The flange 21 is composed of a front flange for being inserted into the guiderail of the device body in case the toner cartridge 19 is mounted in the device body 9, two side flanges for being slid to the cartridge cover, another end flange with means for fastening the toner cartridge 19 into the device body 8.

The toner discharge port 20 of the toner cartridge 19, before being used, is covered with the strip-shaped sheet.

The front edge or the end edge of the toner discharge port 20 is shaped to be slanted in the direction that the toner cartridge 19 is slid as shown in the FIG. 6, or is shaped to be V as shown in FIG. 7.

When the toner cartridge 19 is mounted in the device body 8 of the developing device, the side flange of the toner cartridge 19 is first inserted into the guide rail 12 of the device body 8, and the toner cartridge 19 is slid to the stopper edge 14 of the device body 8.

When the toner cartridge 19 is stopped sliding by the stopper edge 14 of the device body 8, the toner discharge port 20 of the toner cartridge 19 is opposed to the toner reception port 13 of the device body 8.

The strip-like sheet is removed from the toner discharge port 20, and then the toner stored in the toner cartridge 19 is discharged to the inside of the device body 8 through the toner discharge port 20 of the toner cartridge 19 and the toner reception port 13 of the device body 8.

The toner cartridge, is then removed from the device body 8.

Figure 8A:
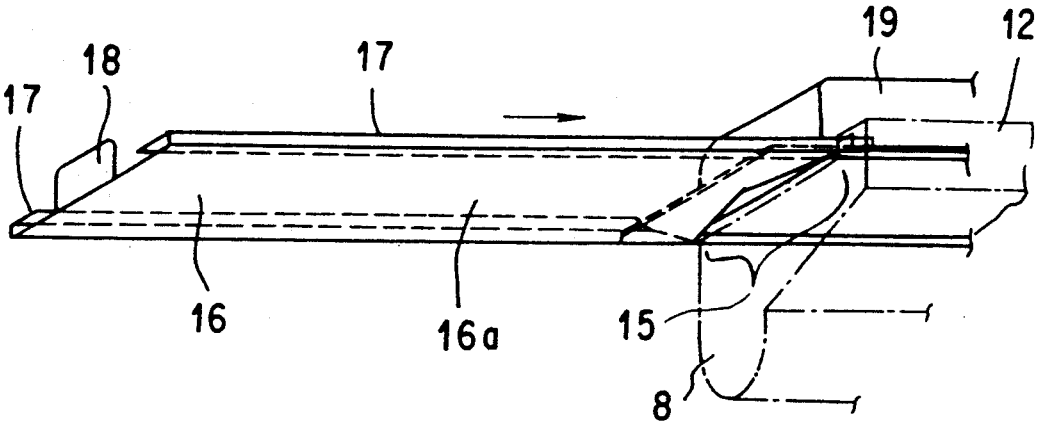
Figure 8B:
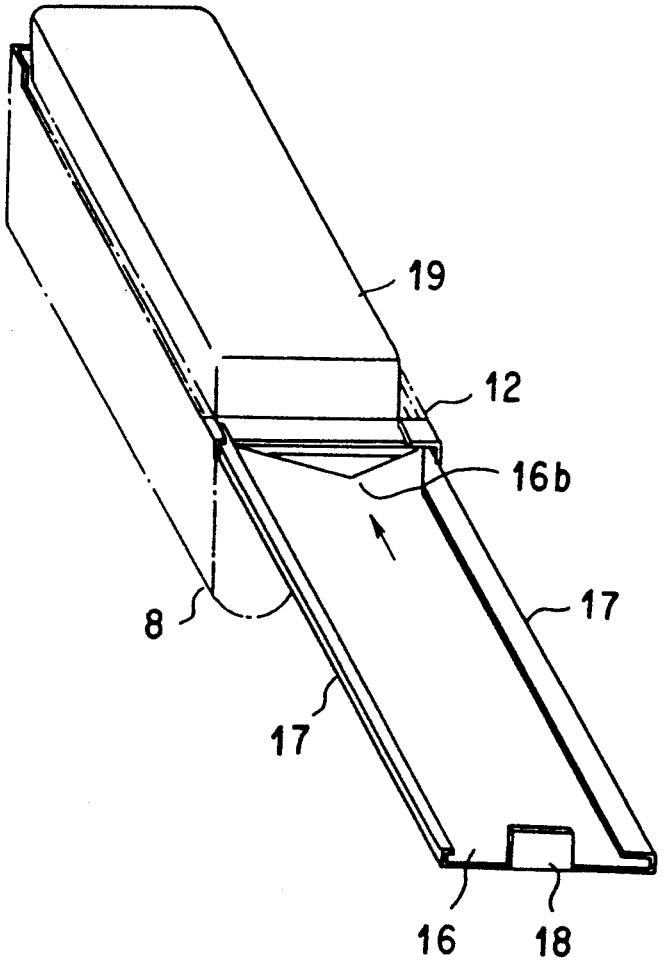
Figure 9A:
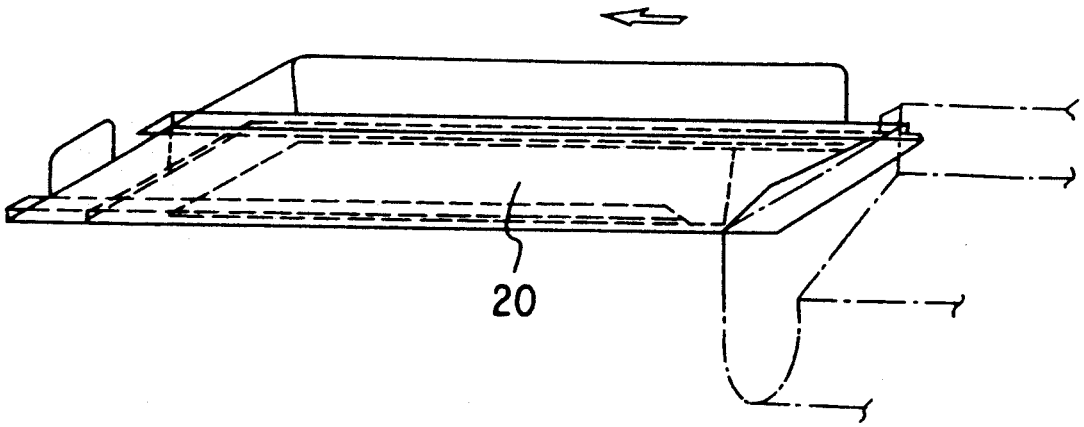
Figure 9B:
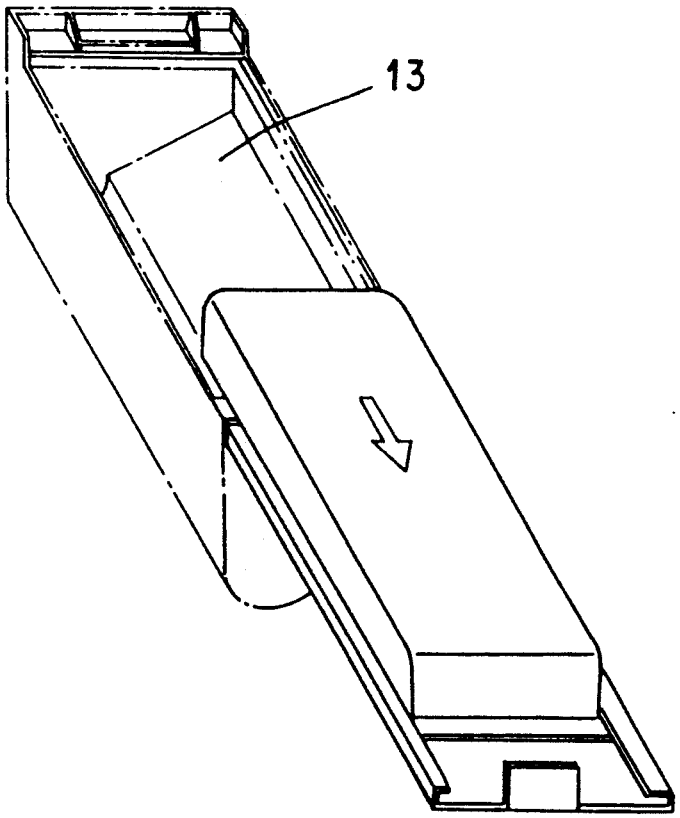
Figure 10A:
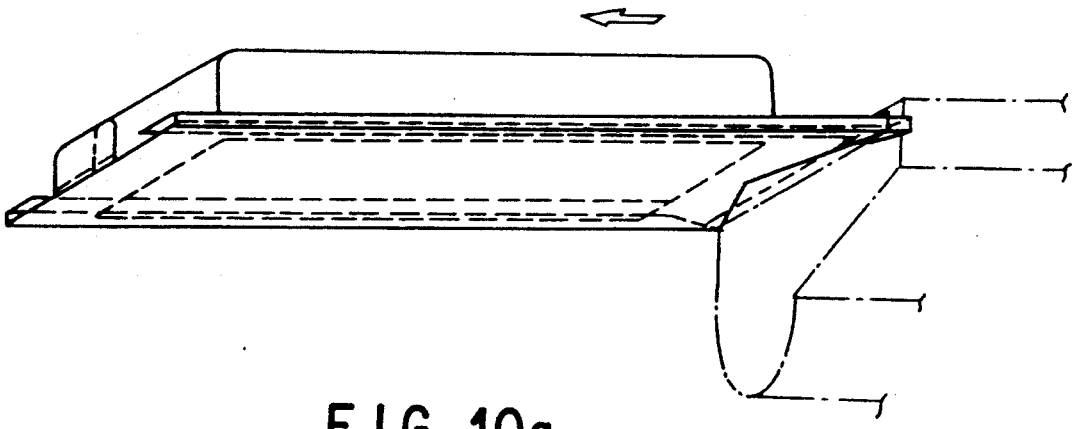
Figure 10B:
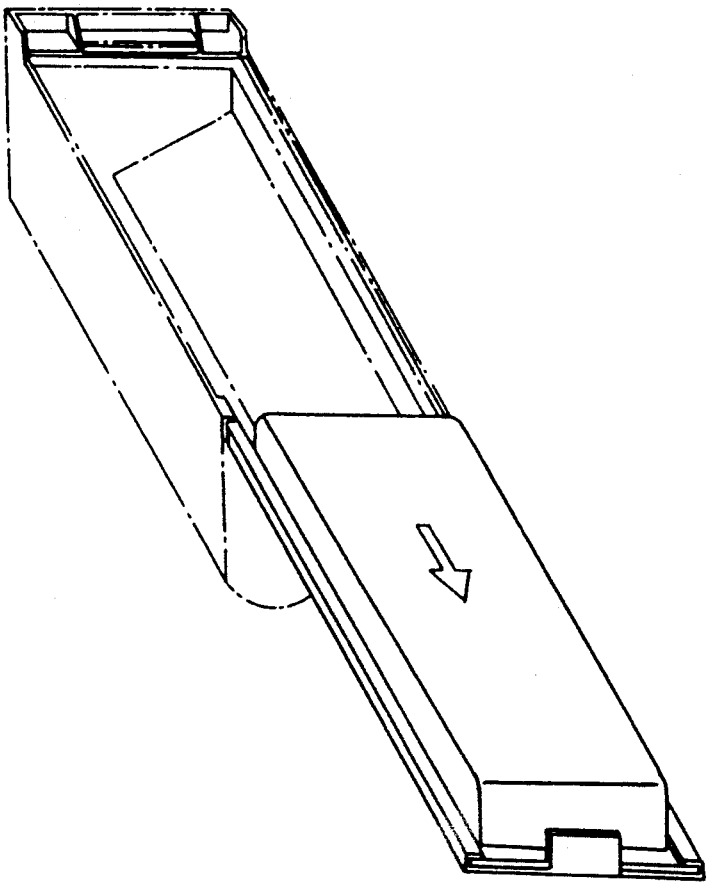
Figure 11:
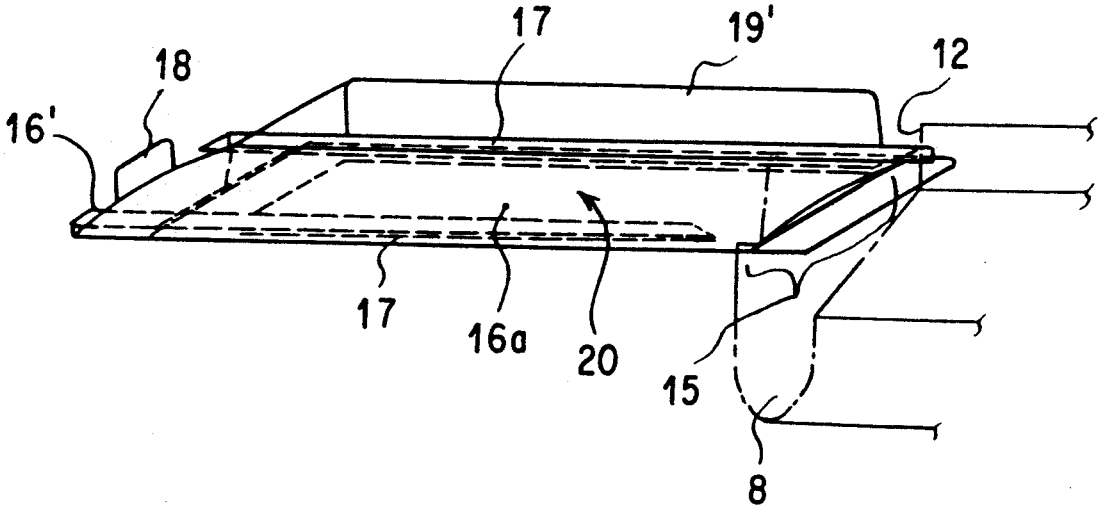
FIG. 11 PRIOR ART
FIGS. 11–14 are perspective views showing the use of the toner cover on the conventional device body of the developing device.
Figure 12A:
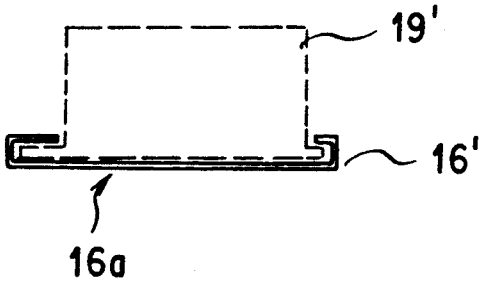
FIG. 12a PRIOR ART
Figure 12B:
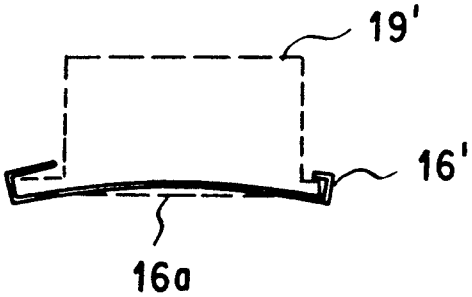
FIG. 12b PRIOR ART
Figure 13A:
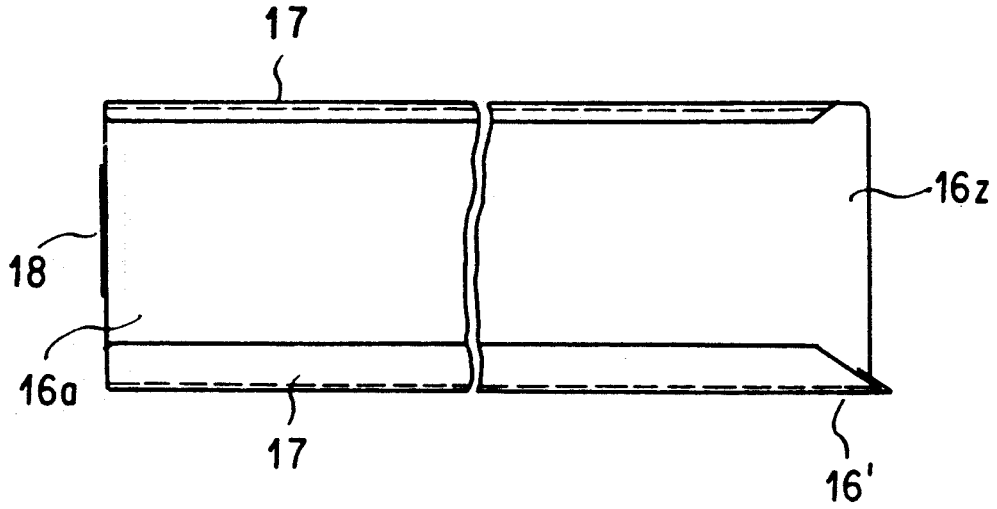
FIG. 13a PRIOR ART
Figure 13B:
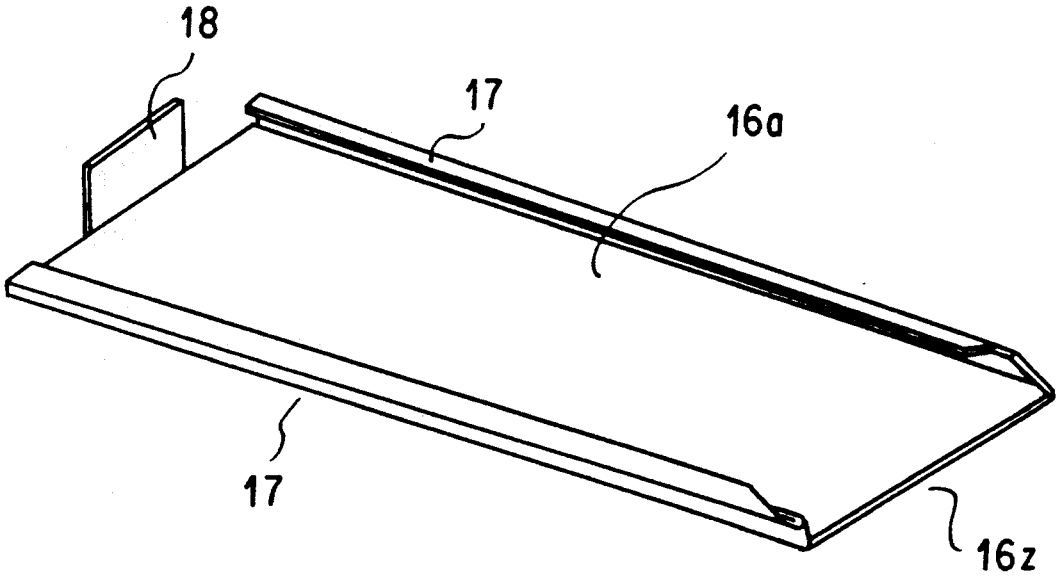
FIG. 13b PRIOR ART
Figure 14A:
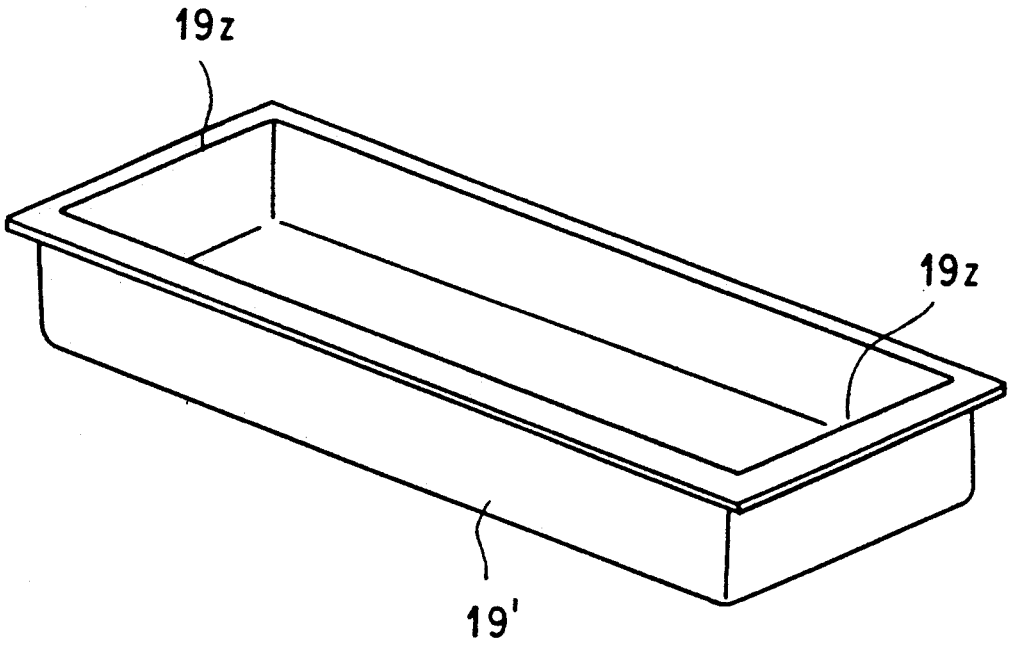
FIG. 14a PRIOR ART
Figure 14B:
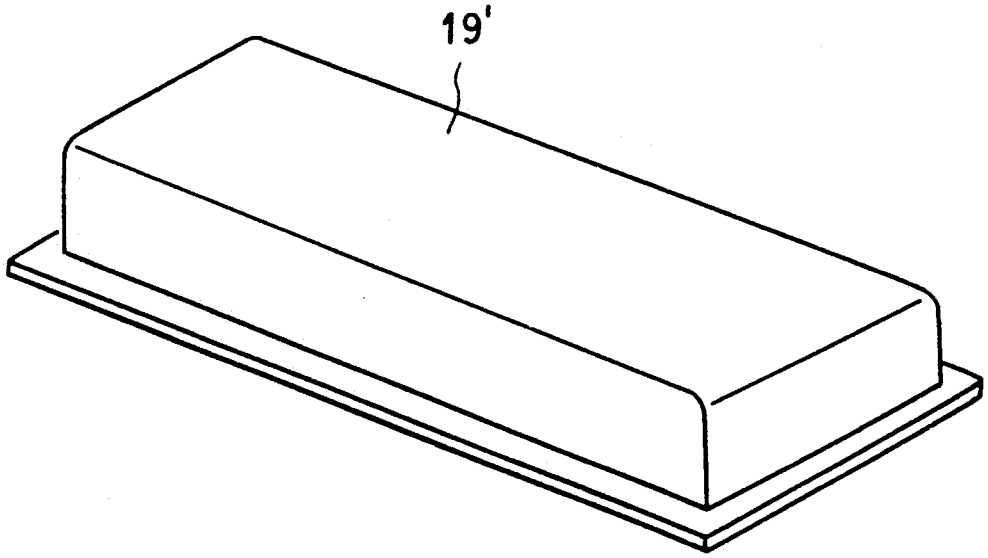
FIG. 14b PRIOR ART

FIGS. 8 to 10 show a toner cover 16 which is used for removing the toner cartridge from the device body 8.

The front edge 16*b* of the toner cover 16 as shown in FIG. 3, is connected to the edge 15 of the device body 8, as shown in FIG. 8.

The toner cartridge 16 is moved from the upper end of the device body 8 to the base 16*a* of the cartridge cover 16 along the guide rails 17 of the device body 8 and the cartridge cover 16, until the front flange of the toner cartridge 19' is stopped sliding by stopper piece 18 of the toner cover 16, as shown in FIG. 9.

Then the base 16*a* of the cartridge cover 16 is covered with the toner discharge port 20 of the toner cartridge 19', as shown in FIG. 10.

The guiderails 17 of the cartridge cover 16 support the side flange of the toner cartridge 19'.

If the base 16*a* of the cartridge cover 16 is bent to the inside of the toner cartridge 19' in the toner cartridge removal, the edge 16*b* of the cartridge cover 16 isn't caught in the edge of the toner discharge port 20.

The front edge 16*b* of the cartridge cover 16 is shaped to be a V.

This shape is one that can avoid being given the force from the edge of the toner reception port 13, when toner cartridge 19 is slid.

A U shape or slant to the edge of the toner discharge port which the front edge 16*d*, 16*e* of the cartridge cover 16 are shaped to be as shown in FIG. 4 and FIG. 5, also can prevent being given the force from the edge of the toner discharge port 20, when toner cartridge 19 is slid.

The idea illustrated in the above developing device may be adjusted to a developing device which has a conventional cartridge cover 16' and a toner cartridge 19 made as shown in FIG. 6 or FIG. 7.

The edge 19*b*, 19*c* of the toner reception port 20 may be shaped to avoid being given the force from the front edge 16*z* of the cartridge cover 16', if the toner cartridge 19 is slid, so that the edge of the toner discharge port 20 is gotten over the front edge 16*z* of the cartridge cover 16'.

The edge 16*z* of the cartridge cover 16' isn't caught in the edge 19*b*, 19*c* of the toner discharge port 20.

What is claimed is:

1. A developing device for supplying toner to a photosensitive member, comprising:

a device body having a toner reception port which supplies toner stored therein to the photosensitive member;

a toner cartridge detachably mounted on the device body in coincidence with the toner reception port, having a toner discharge port opposed to the toner reception port, which supplies toner stored therein to the device body through the ports;

a toner cartridge cover having a base for covering the toner discharge port, side edges for interfacing with the toner cartridge, a front edge for engaging the device body and first contacting the toner cartridge, and a rear edge; and wherein said front edge is shaped to prevent interference with an edge of the toner discharge port when the toner cartridge is slid over the toner cartridge cover, said front edge in the shape of one of a V protruding inward toward the rear edge of the toner cartridge cover, a U protruding inward toward the rear edge of the toner cartridge cover or a slant to the edge of the toner discharge port.

2. A developing device for supplying toner to a photosensitive member, comprising:

a device body having a toner reception port which supplies toner stored therein to a photosensitive member;

a toner cartridge detachably mounted on the device body in coincidence with the toner reception port, having a toner discharge port opposed to the toner reception port, which supplies toner stored therein to the device body through the ports;

a toner cartridge cover having a base for covering said toner discharge port, side edges for interfacing with the toner cartridge and a front edge for engaging the device body and first contacting the toner cartridge; and wherein at least one edge of the toner discharge port is shaped to prevent interference with the front edge of the toner cartridge cover when the toner cartridge is slid over the toner cartridge cover, said at least one edge of the toner discharge port in the shape of one of a V, a U, or a slant to the edge of the toner cartridge cover.

3. A toner cartridge and a toner cartridge cover for use in a photosensitive device, comprising:

a toner cartridge having a toner discharge port and supplying toner stored therein to the photosensitive device;

a toner cartridge cover having a base for covering the toner discharge port, a front edge first contacting the toner cartridge, and a rear edge;

wherein said front edge of the toner cartridge cover is shaped to prevent interference with an edge of the toner discharge port when the toner cartridge is slid over the toner cartridge cover, said front edge in the shape of one of a V protruding inward toward the rear edge of the toner cartridge cover, a U protruding inward toward the rear edge of the toner cartridge cover or a slant to the edge of the toner discharge port; and means for slidably attaching the toner cartridge to the toner cartridge cover.

4. A toner cartridge and a toner cartridge cover for use in a photosensitive device, comprising:

a toner cartridge having a toner discharge port and supplying toner stored therein to the photosensitive device;

a toner cartridge cover having a base for covering the toner discharge port, a front edge first contacting the toner cartridge and a rear edge;

means for slidably attaching the toner cartridge to the toner cartridge cover; and wherein at least one edge of the toner discharge port is shaped to prevent interference with the front edge of the toner cartridge cover when the toner cartridge is slid over the toner cartridge cover, said at least one edge of the toner discharge port in the shape of one of a V, a U, or a slant to the edge of the toner cartridge cover.

5. A toner cartridge and a toner cartridge cover for use in a photosensitive device as claimed in claim 3 wherein the rear edge of the toner cartridge cover includes a stopper for preventing further movement of the toner cartridge past the rear edge of the toner cartridge cover when the toner cartridge is slid over the toner cartridge cover.

6. A toner cartridge and a toner cartridge cover for use in a photosensitive device as claimed in claim 4 wherein the rear edge of the toner cartridge cover includes a stopper for preventing further movement of the toner cartridge past the rear edge of the toner cartridge cover when the toner cartridge is slid over the toner cartridge cover.

* * * * *